US007004894B1

(12) United States Patent
Trotter

(10) Patent No.: US 7,004,894 B1
(45) Date of Patent: Feb. 28, 2006

(54) ABDOMINAL MUSCLE EXERCISE MACHINE

(76) Inventor: Ray Trotter, 1257 N. Volutsia, Wichita, KS (US) 67214

( * ) Notice: Subject to any disclaimer, the term of this patent is extended or adjusted under 35 U.S.C. 154(b) by 0 days.

(21) Appl. No.: 10/640,481

(22) Filed: Aug. 13, 2003

(51) Int. Cl.
*A63B 26/00* (2006.01)
*A63B 71/00* (2006.01)

(52) U.S. Cl. ..... 482/140; 482/142; 482/72

(58) Field of Classification Search ..... 482/140, 482/142, 908, 148, 95, 132, 70–72
See application file for complete search history.

(56) References Cited

U.S. PATENT DOCUMENTS

| | | | | |
|---|---|---|---|---|
| 3,572,701 | A | 3/1971 | Agamian | |
| 4,655,448 | A * | 4/1987 | Harder | 272/144 |
| 5,080,352 | A | 1/1992 | Freed | |
| 5,110,122 | A | 5/1992 | Moore et al. | |
| 5,518,483 | A | 5/1996 | Oswald | |
| 5,518,487 | A | 5/1996 | Hallmark | |
| 5,839,998 | A | 11/1998 | Wilkinson | |
| 5,921,901 | A | 7/1999 | Palacios | |
| 5,951,448 | A * | 9/1999 | Bolland | 482/112 |
| 5,997,450 | A | 12/1999 | Wilkinson | |
| 6,048,293 | A | 4/2000 | Lee | |
| D425,585 | S | 5/2000 | Wu | |
| 6,071,217 | A | 6/2000 | Barnett | |
| 6,206,809 | B1 | 3/2001 | Habing et al. | |
| 6,322,485 | B1 | 11/2001 | Marrero | |
| 6,565,488 | B1 * | 5/2003 | Chen | 482/73 |

* cited by examiner

*Primary Examiner*—Gregory L. Huson
*Assistant Examiner*—L. Amerson
(74) *Attorney, Agent, or Firm*—Kenneth H. Jack; Davis & Jack, L.L.C.

(57) ABSTRACT

An abdominal muscle exercise machine having a body support plate having a lower surface, a front end, and a rear end; front and rear slide shafts; first and second tubular quills slidably interconnecting the front and rear slide shafts and the lower surface of the body support plate for alternate forward and rearward sliding motions of the front and rear slide shaft; a front "T" handle; a roller bracket interconnecting the front "T" handle and the front slide shaft for alternate forward and rearward rolling motion of the front "T" handle along the front slide shaft; and a rear "T" handle fixedly attached to the rear slide shaft.

10 Claims, 3 Drawing Sheets

ABDOMINAL MUSCLE EXERCISE MACHINE

FIELD OF THE INVENTION

This invention relates to apparatus and machinery adapted for facilitating bodily exercise. More particularly, this invention relates to such machinery which is specifically adapted for exercising abdominal muscles.

BACKGROUND OF THE INVENTION

Common modes of abdominal muscle exercise include sit ups, "ab crunches", leg lifts, and kneeling roller assisted thrusts. When performing sit ups, an exerciser typically lies supine upon a flat surface with hands behind the head. In such position, the exerciser repeatedly flexes and extends from the waist between the supine position and a substantially doubled position wherein the exerciser's forehead approaches thighs or knees. A common apparatus for facilitating such sit up exercising motion comprises a flat oblongated padded board having a "T" bar at its foot for engaging and holding the anterior aspects of the exerciser's feet while exercise progresses.

Ab crunches are similar to sit ups with the exception that the exerciser's legs remain flexed with knees raised and with soles of feet pointing downward. In performing ab crunches, the exerciser's bodily motion focuses upon repeatedly tensing and releasing abdominal muscles for bowing the spine, rather than performing gross flexions and extension of the upper body from the waist. Apparatus for facilitating such ab crunch exercising motion typically comprises a flat board having low ledge or bar for engaging and holding the anterior aspects of the exerciser's feet.

In performing leg lifts, an exerciser lies supine upon a floor or flat board and repeatedly moves straightened legs upwardly and downwardly. Exercise equipment for facilitating such leg lift exercise typically comprises an oblongated flat board having a "T" handle at its head, such handle allowing an exerciser to manually anchor his or her upper body upon the board.

In performing wheel assisted abdomen exercising thrusts, an exerciser typically kneels upon a flat floor surface and grasps in left and right hands a wheel having axially extending left and right rotatable handles. The exerciser places such wheel upon the ground, and bodily thrust forwardly from the knees, rolling the wheel forwardly along the floor surface. Upon forwardly and rearwardly repeating such motion in a reciprocating fashion, abdominal muscle exercise is achieved.

A problem associated with articles and apparatus for facilitating the above described abdominal muscle exercises is that they are cumulatively bulky, they are cumulatively difficult to store, they are not economically obtained, and individual articles of such exercise equipment are subject to being separated from others or misplaced or lost.

The instant inventive abdominal muscle exercise machine solves or ameliorates problems noted above by providing a unitary apparatus which is capable of facilitating all of the above described abdominal muscle exercises, which is configurable for compact storage, which is mechanically simple and which is economically fabricated and maintained.

BRIEF SUMMARY OF THE INVENTION

A first structural component of the instant inventive abdominal muscle exercise machine comprises a body support plate. Preferably, the body support plate comprises a sheet of ¾" high density plywood, preferably having dimensions of thirty inches by sixteen inches, and having corners rounded on a one-half inch to three-fourths inch radius. Preferably, the upper surface of the body support plate is padded with a one-half inch to one inch thick layer of dense elastomeric foam, and preferably the upper and side surfaces of the body support plate are upholstered with a sheet of heavy duty vinyl.

Front and rear slide shafts are necessarily provided, said slide shafts preferably respectively comprising four foot and two foot lengths of one and one-half inch square steel tubing. Slidable mounting means interconnecting the under surface of the body support plate and the front and rear slide shafts are provided, such means facilitating forward and rearward sliding motions of the front and rear slide shafts. Slidable mounting of the front and rear slide shafts allows them to be respectively forwardly and rearwardly extended for use, and alternately to be rearwardly and forwardly retracted for storage. A preferred slidable mounting means comprises at least a first, and preferably a pair, of quills or sleeves whose bores are fitted for sliding receipts of the front and rear slide shafts. Such quills are preferably fixedly attached to the lower surface of the body support plate by screws or bolts. Other slidable mounting means such as eye and slide shaft combinations or slide ridge and slide channel combinations may suitably be utilized in place of the preferred quills. Also suitably, the slidable mounting means may alternately comprise forwardly and rearwardly opening slide channels which extend into and are integral with the body support plate, the front and rear slide shafts being fitted for sliding receipts within such channels.

Means for alternately and selectively resisting and permitting sliding motions of the front and rear slide shafts within their preferred quills are preferably provided, such means allowing the front and rear slide shafts to be selectively locked in their extended use positions or locked in their retracted compact storage positions. A preferred means for alternately resisting and permitting sliding motion of the slide shafts comprises shear pin and alignable eye combinations, the eyes extending laterally through opposing side walls of the quills and extending laterally through the slide shafts. The shear pins of such combinations preferably extend laterally through such eyes upon alignment, resulting in double shear locking engagements. Other commonly known releasable latching means may be suitably substituted, such as eye and spring biased lug combinations, set screws, and collet ring clamps.

A front "T" handle is necessarily rollably or slidably mounted upon the front slide shaft by rollable or slidable mounting means. Where rollable mounting means are provided, a roller bracket including ball bearings or wheels as rollers, and supporting laterally extending "T" handles preferably facilitates reciprocating rolling motion of the "T" handle along the front slide shaft. Alternately, low friction sliding motion of the front "T" handle may be facilitated by interposing high density polyethylene (HDPE) plastic pads in place of rollers or ball bearings.

At least a first rear "T" handle is necessarily provided, and preferably a pair of rear "T" handles are provided, the pair comprising a rearmost fixed "T" handle, and an adjustably positionable raised "T" handle. Rear "T" handle mounting means are necessarily provided, such means preferably comprising a fixed weldment of such rearmost "T" handle upon the distal end of the rear slide shaft. The rear "T" handle mounting means preferably further comprises a sliding mount of such raised "T" handle over the rear slide shaft, such "T" handle preferably being raised by an extension shaft four to six inches over the elevation of the body support plate.

Laterally extending stabilizer bars are preferably fixedly mounted upon the quills and upon the distal end of the front slide shaft for prevention of lateral rocking or tilting of the exercise machine during use.

In use of the inventive abdominal muscle exercise machine, and assuming that an exerciser intends to perform sit ups, the exerciser fully extends the rear slide shaft, and fully extends the front slide shaft. Thereafter, the exerciser assumes a supine position upon the body support plate with head facing forwardly, and with lower legs underlying the raised "T" handle. Thereafter, the exerciser may perform sit ups with legs held in a proper lowered position by the left and right arms of the raised "T" handle. In order to perform ab crunches, the exerciser remains in substantially the same position, though with knees raised and feet placed under the rearmost fixedly attached "T" handle. Thereafter, ab crunches may be performed. In order to perform leg lifts, the exerciser lies supine upon the body support platform with head facing rearwardly. In such position, the exerciser may conveniently grasp the fixed "T" handle or the raised "T" handle overhead while performing leg lifts. In order to perform kneeling roller assisted body thrusts, the exerciser kneels upon the body support plate with head facing forwardly while manually grasping the roller or slide mounted "T" handle. In such position, the exerciser's feet may engage or rest upon either of the "T" handles mounted upon the rear slide shaft. In such position, the exerciser may repeatedly bodily thrust forwardly and retract rearwardly, causing the front "T" handle to roll or slide reciprocatingly along the front slide shaft.

Accordingly, it is an object of the present invention to provide an abdominal muscle exercise machine which is capable of facilitating a plurality of abdominal muscle exercises through the provision of a body support plate, through the provision of extendable and retractable slide shafts mounted upon such plate, and through the provision of adjustable, rollable, and slidable "T" handles mounted upon such slide shafts.

It is a further object of the present invention to facilitate compact storability of such exercise machine through provision of structures for rearward and forward retraction of such slide shafts.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
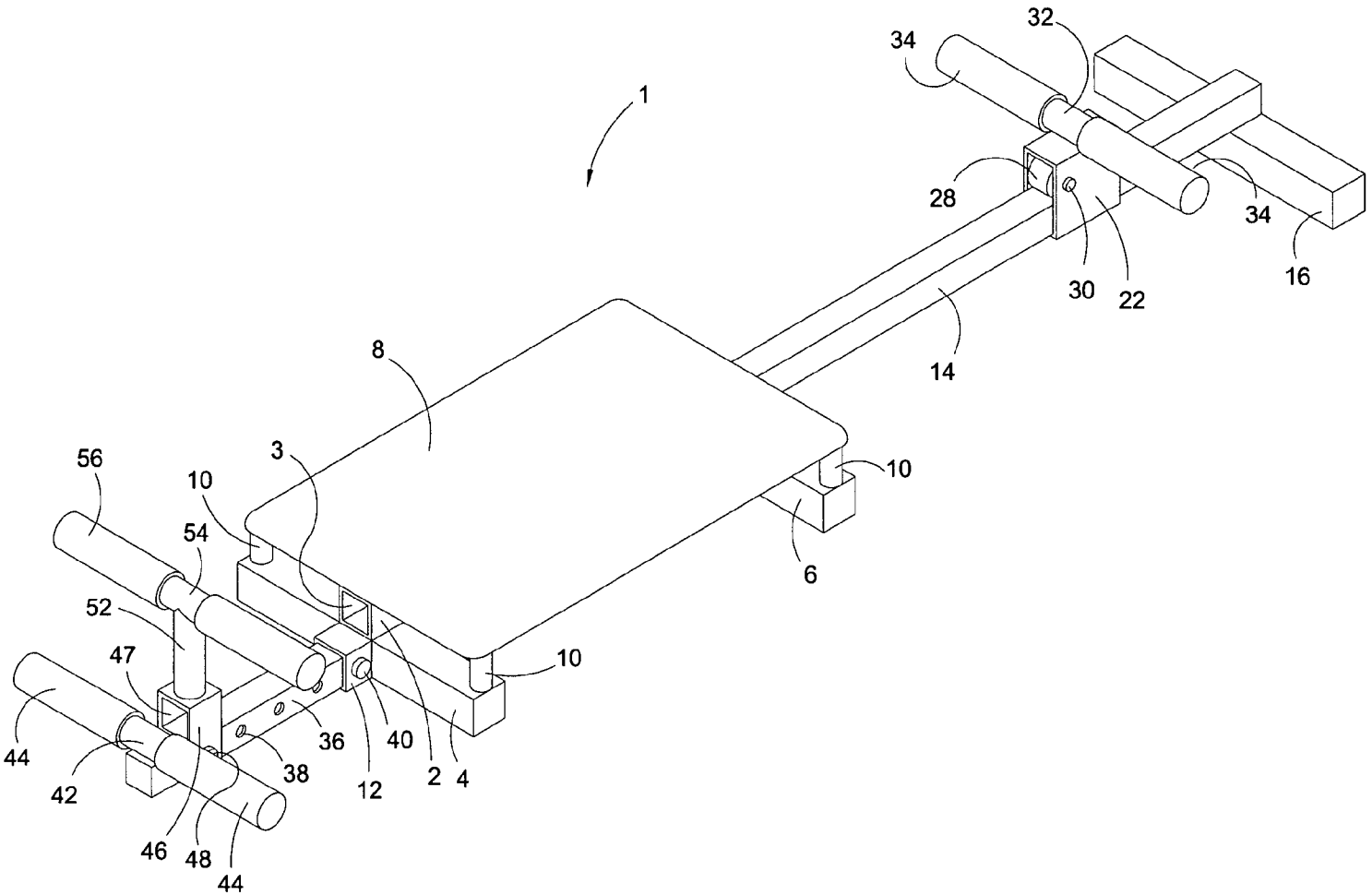
FIG. 1 is an isometric view of the instant inventive abdominal muscle exercise machine.

Referring now to the drawings, and in particular to FIG. 1, a preferred embodiment of the instant inventive abdominal muscle exercise machine is referred to generally by Reference Arrow 1. Said machine 1 has a padded body support plate 8, such plate 8 having a quill or square tubing slide sleeve 2 fixedly attached to its lower surface. The quill 2 has a longitudinally extending hollow bore 3 which is fitted for sliding receipt of a front slide shaft 14. Referring simultaneously to all figures, slide shaft 14 has front and rear laterally extending shear pin receiving apertures 19 and 20, such apertures being releasably locked by a shear pin 18 having an enlarged head, such pin being extendable laterally through shear pin receiving eyes (not within views) which extend laterally through the side walls of the forward end of quill 2.

Figure 2:
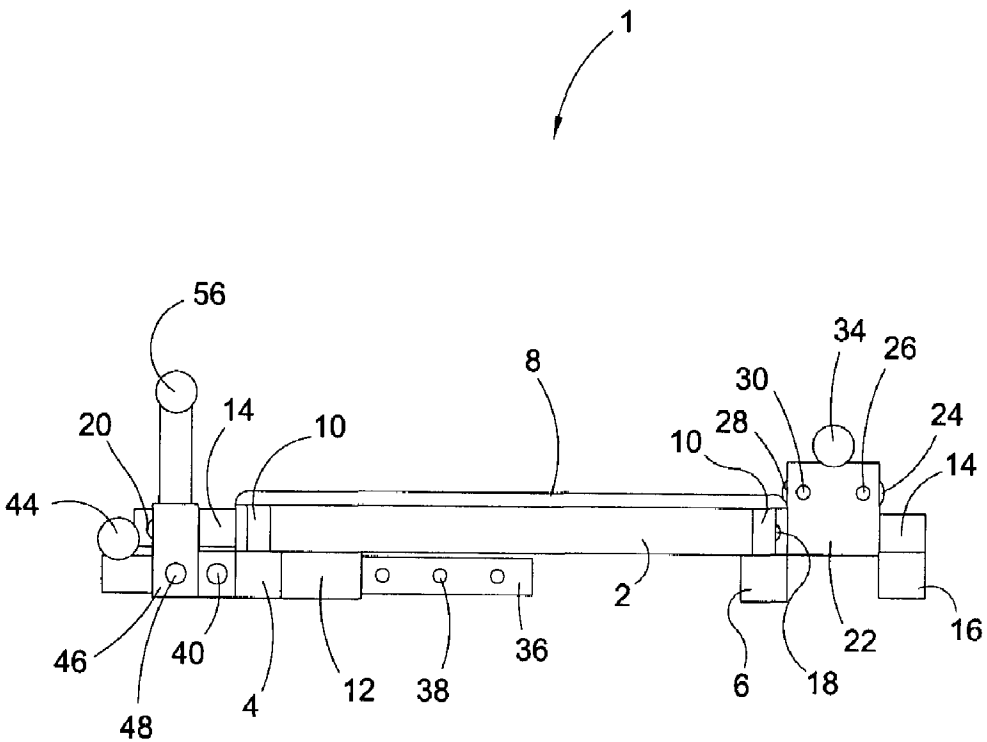
FIG. 2 is a side view of the apparatus depicted in FIG. 1, the view showing the machine in its retracted compact storage configuration.

Referring simultaneously to FIGS. 1 and 2, a second shorter slide sleeve or quill 12 is preferably fixedly mounted, preferably by welding, to the under surface of quill 2, such second lower quill 12 slidably receiving a rear slide shaft 36. Rear slide shaft 36 preferably has a position adjusting series of laterally extending shear pin receiving apertures 38 for releasably locking engagements with shear pin 40, the shear pin 40 being extendable laterally through shear pin receiving eyes (not within views) which extend laterally through the side walls of the rearward end of lower quill 12. Stabilizer bars 4 preferably extend laterally leftwardly and rightwardly from the side walls of lower quill 12, while stabilizer bar 6 crosses the lower surface of quill 2. Similarly, stabilizer bar 16 supports and stabilizes the distal end of the front slide shaft 14. For enhanced rigid support of the body support plate 8, support columns 10 preferably span between and interconnect the lower surface of such plate and the upper surfaces of stabilizer bars 4 and 6.

Referring simultaneously to FIGS. 1 and 2, the front slide shaft 14 extends through a roller bracket 22, such bracket rollably supporting front and rear rollers 24 and 28 upon front and rear axles 26 and 30. A "T" handle bar 32 having left and right cushioned grips 34 is fixedly attached, preferably by welding, to the upper surface of roller bracket 22.

Referring simultaneously to FIGS. 1 and 2, a rear "T" handle 42 configured similarly with "T" handle 32 is preferably fixedly welded to the distal end of the rear slide shaft 36, the rear "T" handle preferably having left and right cushioned grips 44.

Referring further simultaneously to FIGS. 1 and 2, an intermediate, raised, and longitudinally adjustably mounted "T" handle 54 is upwardly extended over a slide bracket 46 by post 52, the "T" handle 54 preferably having left and right cushioned grips 56. Slide bracket 46 preferably has upper and lower partitioned channels, the upper channel 47 receiving the proximal end of the front slide shaft 14 upon full retraction to the storage configuration depicted in FIG. 2. The lower channel of the slide bracket 46 slidably receives the rear slide shaft 36. Shear pin 48 releasably locks slide bracket 46 and "T" handle 54 over selected shear pin receiving apertures 38.

Figure 3:
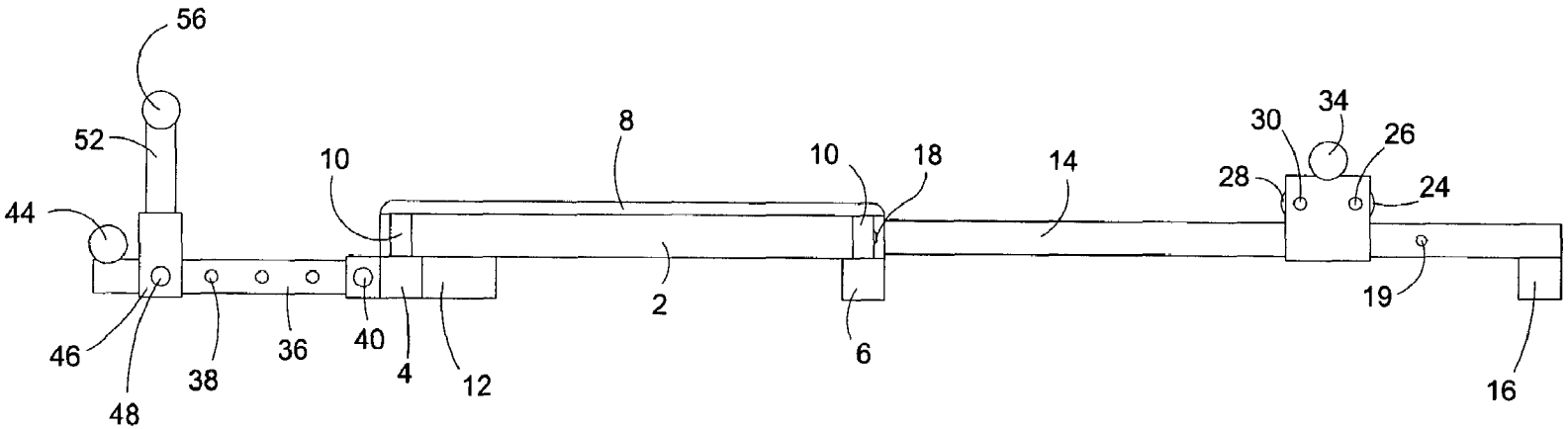
FIG. 3 is a side view of the machine depicted in FIG. 1, the view showing the machine in its extended and configured for exercising use.

Referring simultaneously to FIGS. 1, 2, and 3, the inventive abdominal muscle exercise machine 1 may be configured as depicted for compact storage beneath a bed or within a closet. While the machine 1 is configured as depicted in FIG. 2, handles 42, 54, or 32 may be conveniently used for carrying the machine 1 from such storage location to a desired exercising location. Upon reaching a desired exercise location, the machine 1 is placed upon a flat floor surface, allowing stabilizer bars 4, 6, and 16 to rest upon such surface. Thereafter, the exerciser may manually laterally extract shear pins 18 and 40 by pulling upon their enlarged heads. Thereafter, the exerciser may slidably forwardly move the front slide shaft 14 from the position depicted in FIG. 2 to the position depicted in FIG. 3.

Thereafter, shear pin 18 may be reinserted, such pin engaging aperture 20 rather than, referring to FIG. 3, aperture 19. Thereafter, the exerciser may slidably move rear slide shaft 36 rearwardly to a desired rearwardly extended position, and may reinsert shear pin 14 through the selected shear pin receiving aperture 38. Thereafter, the position of "T" handle 54 may be similarly longitudinally adjusted through extraction of shear pin 48, sliding adjustment f slide bracket 46, and through reinsertion of pin 48 through a selected shear pin aperture 38.

Upon configuring the abdominal muscle exercise machine 1 in the extended position depicted in FIG. 3, the exerciser may perform roller assisted forward thrusts by kneeling upon plate 8, resting feet upon handles 42 or 54, and by grasping handles 32. In such position, the exerciser may alternatingly thrust forwardly and retract rearwardly, causing rollers 24 and 28 of roller bracket 22 to roll along the upper surface of front slide shaft 14.

Alternately, referring simultaneously to FIGS. 1 and 3, such exerciser may lie supine upon plate 8 with head oriented rearwardly. In such position, the exerciser may grasp handles 42 or 54 and may perform abdominal muscle exercising leg lifts. Also alternately, such exerciser may lie supine upon plate 8, with head oriented forwardly. In such orientation, the exerciser may perform sit ups with legs extending beneath the arms of "T" handle 54 or may perform ab crunches with knees flexed and feet inserted beneath the arms of "T" handle 42.

Referring simultaneously to all figures, a reversal of the steps described above for configuring the machine 1 for exercise compactly retracts slide shafts 36 and 14, configuring the machine 1 as depicted in FIG. 2.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An abdominal muscle exercise machine comprising:

(a) a body support plate having a lower surface, a front end, and having a rear end;

(b) front and rear slide shafts, each having proximal and distal ends;

(c) slidable mounting means slidably interconnecting the front and rear slide shafts to the lower surface of the body support plate, the slidable mounting means facilitating alternate and forward rearward sliding motions of the front and rear slide shafts;

(d) a front "T" handle;

(e) rollable or slidable mounting means interconnecting the front "T" handle and the front slide shaft, the rollable or slidable mounting means facilitating alternate forward and rearward rolling or sliding motions of the front "T" handle along the front slide shaft; the rollable or slidable mounting means positioning the "T" handle for reciprocating motions of the "T" handle alternately toward the front slide shaft's distal end and toward the front slide shaft's proximal end;

(f) at least a first rear "T" handle; and (g) rear "T" handle mounting means interconnecting the at least first rear "T" handle and the rear slide shaft.

2. The abdominal muscle exercise machine of claim 1 wherein the slidable mounting means comprise at least a first quill.

3. The abdominal muscle exercise machine of claim 2 further comprising a plurality of stabilizer bars, each stabilizer bar being fixedly attached to the at least first quill, to the lower surface of the body support plate, or to the distal end of the front slide shaft.

4. The abdominal muscle exercise machine of claim 3 further comprising a second rear "T" handle, the rear "T" handle mounting means extending the second rear "T" handle upwardly from the rear slide shaft and facilitating alternate forward and rearward sliding motions of the second rear "T" handle along the rear slide shaft.

5. The abdominal muscle exercise machine of claim 4 wherein the slidable mounting means further comprises a second quill, the front and rear slide shafts being respectively received by the at least first quill and the second quill.

6. The abdominal muscle exercise machine of claim 5 wherein the slidable mounting means further comprises means for alternately existing and permitting forward and rearward sliding motions of the forward and rearward slide shafts.

7. The abdominal muscle exercise machine of claim 6 wherein the means for alternately resisting and permitting forward and rearward sliding motions of the front and rear slide shafts comprises eye and shear pin combinations.

8. The abdominal muscle exercise machine of claim 7 wherein the first and second quills comprise lengths of square or rectangular tubing.

9. The abdominal muscle exercise machine of claim 8 wherein the body support plate has a cushioned upper surface.

10. The abdominal muscle exercise machine of claim 9 wherein the at least first rear "T" handle is rigidly attached to the distal end of the rear slide shaft.

* * * * *